US010800587B2

(12) United States Patent
Wood

(10) Patent No.: US 10,800,587 B2
(45) Date of Patent: Oct. 13, 2020

(54) SEPARATABLE AGENT DOSES

(71) Applicant: Henkel IP & Holding GmbH, Duesseldorf (DE)

(72) Inventor: Jason Wood, Darien, CT (US)

(73) Assignee: Henkel IP & Holding GmbH (DE)

( * ) Notice: Subject to any disclaimer, the term of this patent is extended or adjusted under 35 U.S.C. 154(b) by 77 days.

(21) Appl. No.: 16/023,461

(22) Filed: Jun. 29, 2018

(65) Prior Publication Data

US 2020/0002073 A1 Jan. 2, 2020

(51) Int. Cl.

| | |
|---|---|
| ***B65D 65/46*** | (2006.01) |
| ***C11D 17/04*** | (2006.01) |
| ***B65D 75/58*** | (2006.01) |
| ***B65B 51/10*** | (2006.01) |
| ***B65B 11/50*** | (2006.01) |
| ***B65D 77/20*** | (2006.01) |

(52) U.S. Cl.

CPC ..... *B65D 75/5838* (2013.01); *B65B 11/50* (2013.01); *B65B 51/10* (2013.01); *B65D 65/46* (2013.01); *B65D 75/5811* (2013.01); *B65D 77/2024* (2013.01); *B65D 2577/205* (2013.01); *C11D 17/042* (2013.01)

(58) Field of Classification Search

CPC ..... B65D 65/46; B65D 75/5811; B65D 77/5838; B65D 77/2024; B65D 2577/205; B65B 11/50; B65B 51/10; C11D 17/042

USPC ..... 206/77.1, 37, 38, 223, 820; 225/77

See application file for complete search history.

(56) References Cited

U.S. PATENT DOCUMENTS

| | | | | |
|---|---|---|---|---|
| 3,198,740 | A | 8/1965 | Dunlop et al. | |
| 3,485,349 | A * | 12/1969 | Chaney, Jr. | B65D 75/42 206/209 |
| 4,839,076 | A * | 6/1989 | Willman | C11D 17/044 206/0.5 |
| 4,846,992 | A | 7/1989 | Fonsny | |
| 5,160,654 | A | 11/1992 | Falou et al. | |
| 5,176,275 | A | 1/1993 | Bowie | |
| 5,294,361 | A | 3/1994 | Van den Brom et al. | |
| 5,316,400 | A | 5/1994 | Hoyt et al. | |
| 5,783,541 | A | 7/1998 | Tack et al. | |
| 5,971,138 | A * | 10/1999 | Soughan | A47K 10/38 206/210 |
| 6,133,214 | A | 10/2000 | Jung et al. | |
| 6,521,581 | B1 | 2/2003 | Hsu et al. | |
| 6,863,960 | B2 | 3/2005 | Curro et al. | |
| 8,069,985 | B2 | 12/2011 | Burattini | |
| 2002/0086806 | A1 * | 7/2002 | Giblin | B65D 75/5811 510/296 |
| 2003/0108705 | A1 * | 6/2003 | Duffield | A61J 3/07 428/36.6 |
| 2005/0003982 | A1 | 1/2005 | Beckholt | |
| 2005/0119150 | A1 | 6/2005 | Pegelow et al. | |
| 2006/0122088 | A1 | 6/2006 | Sadlowski et al. | |

(Continued)

*Primary Examiner* — Luan K Bui

(74) *Attorney, Agent, or Firm* — Bojuan Deng

(57) ABSTRACT

An agent dose delivery system including: a first water-soluble film; a second film adhered to the first film; a first compartment and second compartment formed by the first film and the second film; a first agent composition in the first compartment; a second agent composition in the second compartment; and a perforated tear line between the two compartments allowing separation of the two compartments by hand without opening either compartment.

16 Claims, 8 Drawing Sheets

(56) References Cited

U.S. PATENT DOCUMENTS

| | | | | |
|---|---|---|---|---|
| 2012/0138654 | A1* | 6/2012 | Lee | A47K 10/3827 225/39 |
| 2016/0251148 | A1* | 9/2016 | Edwards | B65B 3/022 206/461 |
| 2017/0096275 | A1* | 4/2017 | Geeraert | B65D 85/804 |
| 2017/0247172 | A1* | 8/2017 | Edwards | B65D 75/42 |
| 2018/0057776 | A1* | 3/2018 | Brandt Sanz | B65B 9/023 |
| 2018/0223229 | A1* | 8/2018 | Tan | C11D 17/044 |

* cited by examiner

SEPARATABLE AGENT DOSES

BACKGROUND

The use of premeasured doses for cleaning applications has seen adoption in laundry and dishwashing applications. These packets provide the consumer with a prepared amount of agent to place in the machine, avoiding the potential for mess and/or error associated with pouring and transferring the agent.

BRIEF DESCRIPTION OF THE DRAWINGS

The accompanying drawings illustrate various examples of the principles described herein and are a part of the specification. The illustrated examples do not limit the scope of the claims.

Figure 1A:
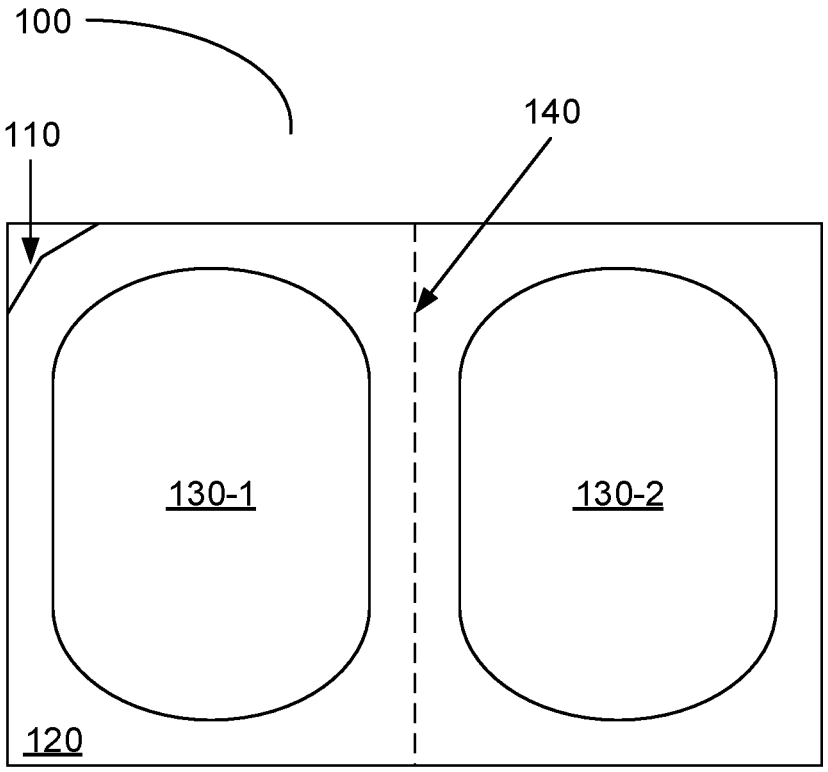
FIG. 1A shows a plan view of an example of an agent dose delivery system consistent with this specification.

Throughout the drawings, identical reference numbers designate similar, but not necessarily identical, elements. The figures are not necessarily to scale, and the size of some parts may be exaggerated or minimized to more clearly illustrate the example shown. The drawings provide examples and/or implementations consistent with the description. However, the description is not limited to the examples and/or implementations shown in the drawings.

DETAILED DESCRIPTION

The use of single dose packets for cleaning has seen increasing adoption by consumers. Single dose packets do not require measuring of the materials. Single dose packets are easier to handle and pickup in the event of spills.

There can be mismatch between the amount of agent in a single dose packet and load to be washed. It is not unusual for a consumer to occasionally need to wash a small load of material. In such cases, using the amount of agent for a full load may be excessive and/or wasteful. With powders and liquids, consumers could adjust the amount of agent they provided to match the demands of the load. More agent could be used with heavily soiled loads. Less agent could be used with lightly soiled loads. This flexibility has not been availability in single dose packets.

As used in this specification and the associated claims, an "agent" is a chemical which is added to a solvent to perform a process. An agent may be a detergent, a brightener, a bleach, a perfume, a dye, an enzyme, a builder, a chelator, a pH modifier, etc. The type of agent depends on the process to be performed. An agent may be a liquid and/or solid. An agent may be an emulsion, a colloid, and/or other more complex state. An "agent composition" may include the agent alone and/or the agent with other active and/or inert materials.

This specification, among other examples, describes single dose packets which may be separated into smaller units, for example, to run partial loads. In an example, the single dose packet is hand separatable into two packets with equivalent amounts of agent. The use of a single dose packet that may be used "as is" for the majority of loads minimizes the amount of work adjustment for the consumer. However, the consumer retains the ability to rapidly modify the amount of agent to be used by tearing the packet along a prepared zone. The prepared zone may be a set of perforations, a thinned region, a notched/cut zone, etc. The prepared zone allows separation both pieces without compromising the integrity of compartments on either piece.

As used in this specification and the associated claims, the term equivalent describes two items that are functionally similar and within 10% of each other as assessed by the relevant parameter, such as volume, mass, length, etc.

Among other examples, this specification describes an agent dose delivery system which includes: a first water-soluble film; a second film adhered to the first film; a first compartment and second compartment formed by the first and second films; a first agent composition in the first compartment; a second agent composition in the second compartment; and a perforated tear line between the two compartments allowing separation of the two compartments by hand without opening either compartment.

This specification also describes an agent dose delivery system which includes: a first strip of water-soluble film; a second strip of water-soluble film adhered to the first strip of water-soluble film; a plurality of compartments of a first size formed by the first and second strips of water-soluble film, the plurality of compartments containing a first agent composition; and a plurality of weakened areas located between the compartments such that the weakened areas may be used to separate adjacent compartments without rupturing either adjacent compartment.

Among other examples, this specification also describes an agent dose delivery system including: a first sheet and second sheet of water-soluble polymer; a first compartment and second compartment formed between the first and second sheets of water soluble polymer; a first quantity of agent in the first compartment and second quantity of agent in the second compartment, wherein the first quantity and the second quantity are equivalent; and a separation zone between the first compartment and the second compartment, the separation zone allowing manual separation of the first compartment from the second compartment without compromising an integrity of either compartment.

Figure 1B:
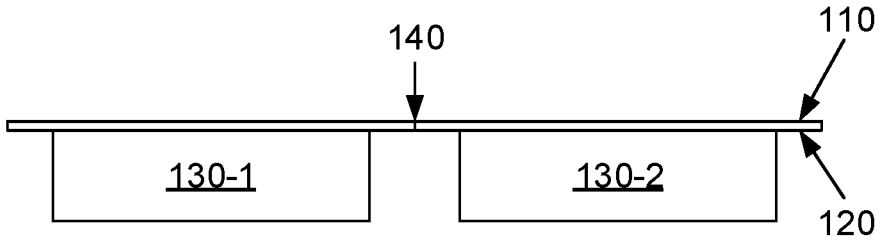
FIG. 1B shows a side view of the system of FIG. 1A.

Turning now to the figures, FIG. 1 shows a plan view of an example of an agent dose delivery system (100) consistent with this specification. FIG. 1B shows a side view of the system (100) of FIG. 1A. The system (100) is an agent dose delivery system which includes: a first water-soluble film (110); a second film (120) adhered to the first film; a first compartment (130-1) and second compartment (130-2) formed by the first film (110) and second film (120); a first agent composition in the first compartment (130); a second agent composition in the second compartment (130); and a perforated tear line (140) between the two compartments (130) allowing separation of the two compartments (130) by hand without opening either compartment (130).

The system (100) is an agent dose delivery system (100). The system allows a single packet to be provided for a full and/or normal load of material to be cleaned. The system (100) also allows the packet to be divided, for instance, when a smaller amount of cleaning agent is desired.

The first film (110) is a water-soluble film. The first film (110) contains the agent during shipping and storage. However, when placed into a volume of water, the first film (110) dissolves and releases the agent. In an example, the film dissolves in a washing machine. The first film (110) may be substantially flat. The first film (110) may be shaped to form non-flat portions of the compartments (130). The water-soluble film (110) may be polylactic acid (PLA). The water soluble film (110) may be polyglycolic acid (PGA). The water soluble film (110) may be an acrylate. The water soluble film (110) may be another water soluble polymer.

The second film (120) may be a water-soluble film. The second film may water stable. In an example, the second film (120) has the same composition as the first film but is thicker. The compartments are shaped in the second film, filled and then the first film is attached over the tops of the compartments (130). This approach allows the thinner first film (110) to control the time to release. Since the first film (110) may be maintained more uniform in thickness, reduced variation in time to release is achieved.

The second film (120) may be a recyclable material. The second film may be selected from a material that resists transfer at temperatures used for drying. The second film (120) may be formed to include holes and/or other features to increase attachment between the first film (110) and second film (120). In an example, the second film may include a lip around the edge of the compartments (130) and multiple holes on the side of the lip away from the compartment. The water-soluble first film may be heated and pressed through the holes to form a mechanical interlock between the first film (110) and second film (120).

The first film (110) and second film (120) form the walls of the compartments (130). The compartments (130) may have similar shapes and dimensions as shown in FIGS. 1A and 1B. The compartments (130) may have different shapes from each other. The compartments may have aesthetic and fanciful shapes, for example an agent with a rose scent may be placed in a compartment with a rose-like shape. The agent may be colored, for example, red or yellow, to show the color of the rose. Such shapes and colors may aid a user in distinguishing different agents. The compartment may form a trademarked shape. The compartments (130) may include numbers, letters, and/or symbols in the first film (110) and/or second film (120).

The compartments (130) may be the same depth. The compartments (130) may be of different depths (130). The compartments may include secondary, tertiary, etc. compartments to hold multiple agent compositions. In an example, a first compartment is designed to release material at a first time point after immersion and another compartment (130) is designed to release material at a second time point after immersion. For example, the first compartment (130) may open at 5 minutes after immersion and the other compartment (130) may open at 18 minutes.

The first agent may be the same as the second agent. The first agent and second agents may be different agents. The agent compositions may include a detergent. The agent compositions may include surfactants, including anionic, cationic, non-ionic, and/or zwitterion (amphoteric) surfactants. The agent compositions may include a dye, a perfume, and/or other adjuvant. The agent compositions may include a builder, a chelator, and/or an enzyme. The agents may be a pH adjuster, water hardness modifier, shock, and/or other component to adjust the composition of a pool, spa, or similar. The agents include bath salts. The agent compositions may include a dye. For example, the first agent may provide a base dye composition and the second agent modify the first composition to a produce a second color dye.

The first compartment (130-1) and the second compartment (130-2) are separated by a perforated tear line (140). The perforated tear line (140) allows the first and second compartments to be separated by hand without a tool. The perforated tear line (140) should not compromise the integrity of the compartments when the perforated tear line (140) is used to separate the compartments (130). The perforated tear line may have a very low tear force. In an example, the force to tear the perforated tear line is greater than 0.1 lbf and less than 5 lbf. The force to tear the perforated tear line (140) may be greater than the weight of either portion of the system (100). The force to separate may be optimized based on the expected handling of the system (100) and the expected user profile. The force to separate should be high enough to keep the parts of the system (100) together during handling, including transportation, shipping, loading, etc. The force to separate should be low enough to be readily accomplished by a wide variety of users without difficulty and/or effort. The use of mechanical features to concentrate the force may reduce the force used. The modification of thickness and material properties of the films may be used to change the force to separate the parts of the system (100). The size and shape of the perforations may also be used to modify the separating force.

The perforated tear line (140) may pass through the first film (110), the second film (120), and/or both films (110, 120). In an example, the area with the perforated tear line (140) is through an area with both films (110, 120) adhered and/or joined together. In an example, one of the films is present only near the compartments (130) and is not present between the compartments (130) on the perforated tear line (140). One of the films (110, 120) may be sliced through and/or separated over the perforated tear line (140) such that the other film (110, 120) holds the parts of the system (110) together.

In an example, the perforated tear line (140) may have a higher force to initiate tearing and a lower force to propagate the tear. This may be a result of using non-uniform sized and/or shaped perforations. This may be the result of modifying the shape of the end perforations. This may be the result of modifying the thickness of the film (110,120) near the perforations. Having a higher initiation force may reduce accidental tears. Another approach is to increase the force as the tearing propagates. This can be accomplished by using varying size perforations and/or modifying the spacing of the perforations. Similarly, the material may be modified to make the layer thicker, thinner, harder, stiffer, softer, etc. as desired.

The system (100) may be a sheet comprising rows and columns of separatable dose units. Each dose unit comprising a compartment (130). A dose unit may comprise multiple compartments (130).

Figure 2:
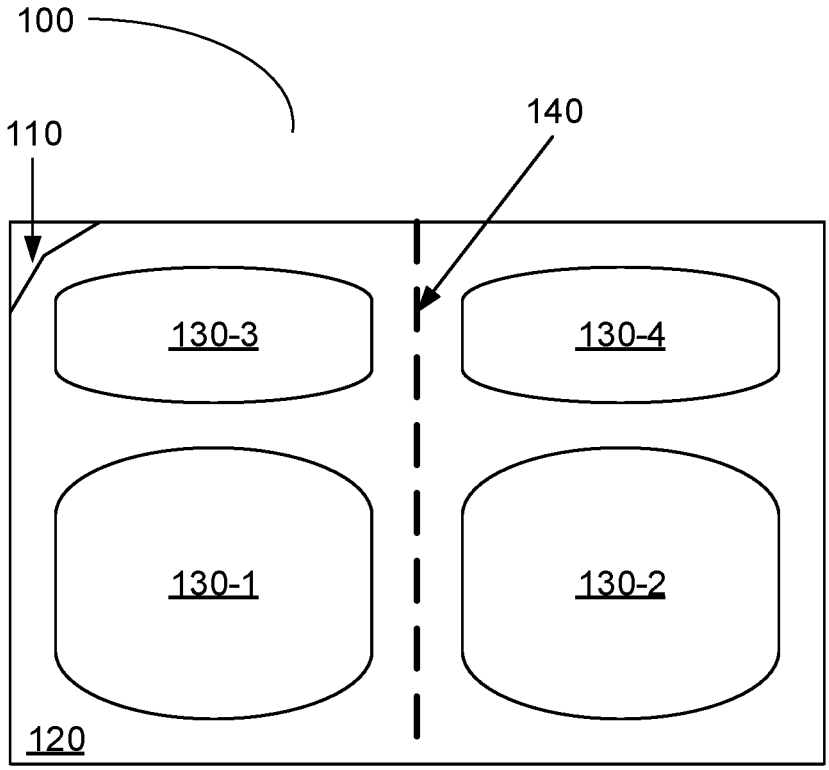
FIG. 2 shows a plan view of an example of an agent dose delivery system consistent with this specification.

FIG. 2 shows a plan view of an example of an agent dose delivery system (100) consistent with this specification. The system (100) in FIG. 2 includes a first film (110), a second film (120), four compartments (130), and perforated tear line (140) dividing the compartments into two groups.

The compartments (130) may be organized into any number of clusters, each cluster able to be separated using a perforated tear line (140). In an example, the system may be manually separated without tools and/or other equipment into two equivalent fractions. The system (100) may be separatable into thirds, fourths, and/or other distributions, such as ⅓ and ⅔. Allowing more separations allows more flexibly in dosing but also increases the amount of clutter as fractions remain between loads. Accordingly, there is a tradeoff between allowing more customization and simplicity of design. The perforated tear line (140) may be located between a secondary component and a main component. For example, one set of compartments (130) may include a detergent and the other set of compartments may include a bleach for use with whites. One side may include a fragrance, allowing use or non-use of the fragrance by the user.

Figure 3:
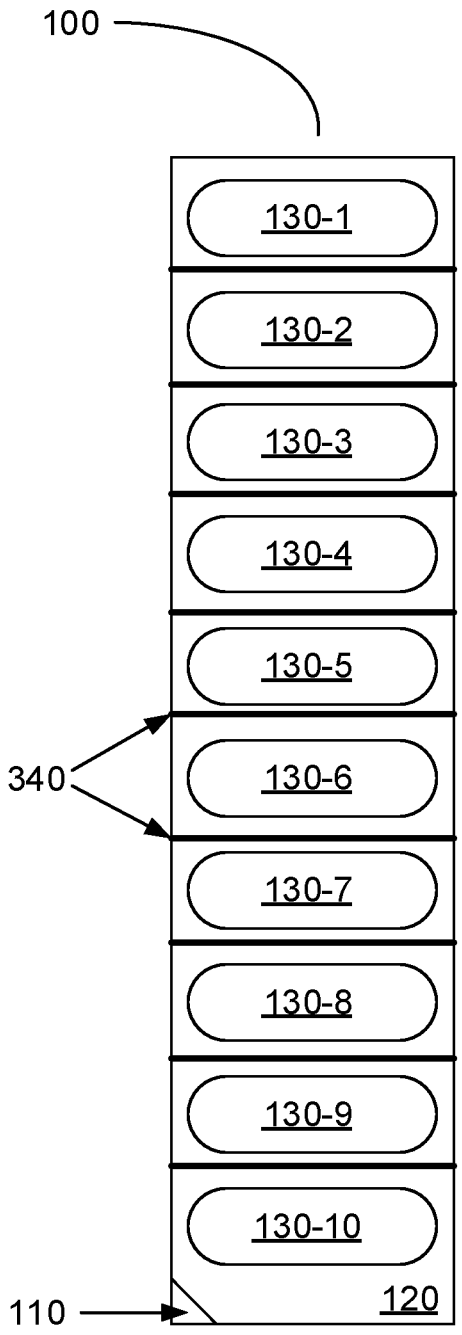
FIG. 3 shows a plan view of an example of an agent dose delivery system consistent with this specification.

FIG. 3 shows a plan view of an example of an agent dose delivery system (100) consistent with this specification. The agent dose delivery system (100) includes: a first strip of water-soluble film (110); a second strip of water-soluble film (120) adhered to the first strip of water-soluble film (110); a plurality of compartments (130) of a first size formed by the first (110) and second strips of water-soluble film (120), the plurality of compartments (130) containing a first agent composition; and a plurality of weakened areas (340) located between the compartments (130) such that the weakened areas (340) may be used to separate adjacent compartments (130) without rupturing either adjacent compartment (130).

The agent dose delivery system (100) forms a strip with multiple compartments (130) holding agent. Weakened areas (340) are positioned to allow separation of the compartments (130) as needed. In an example, each weakened area (340) is similar. In an example, alternating weakened areas (340) have different tear profiles. The weakened areas (340) may include a perforated tear line (140). In an example, there is a weakened area (340) between each pair of adjacent compartments (130). In an example, there is a weakened area (340) between every other pair of adjacent compartments (130). The weakened areas (340) may be used to define clusters of compartments (130) for a consumer to use. The weakened areas (340) may have a different structure than the adjacent areas of the film (110, 120). In an example, the weakened areas are allowed to crystallize while the adjacent areas are amorphous in order to facilitate crack propagation in the weakened area (340) compared with an adjacent non-weakened area.

Figure 4:
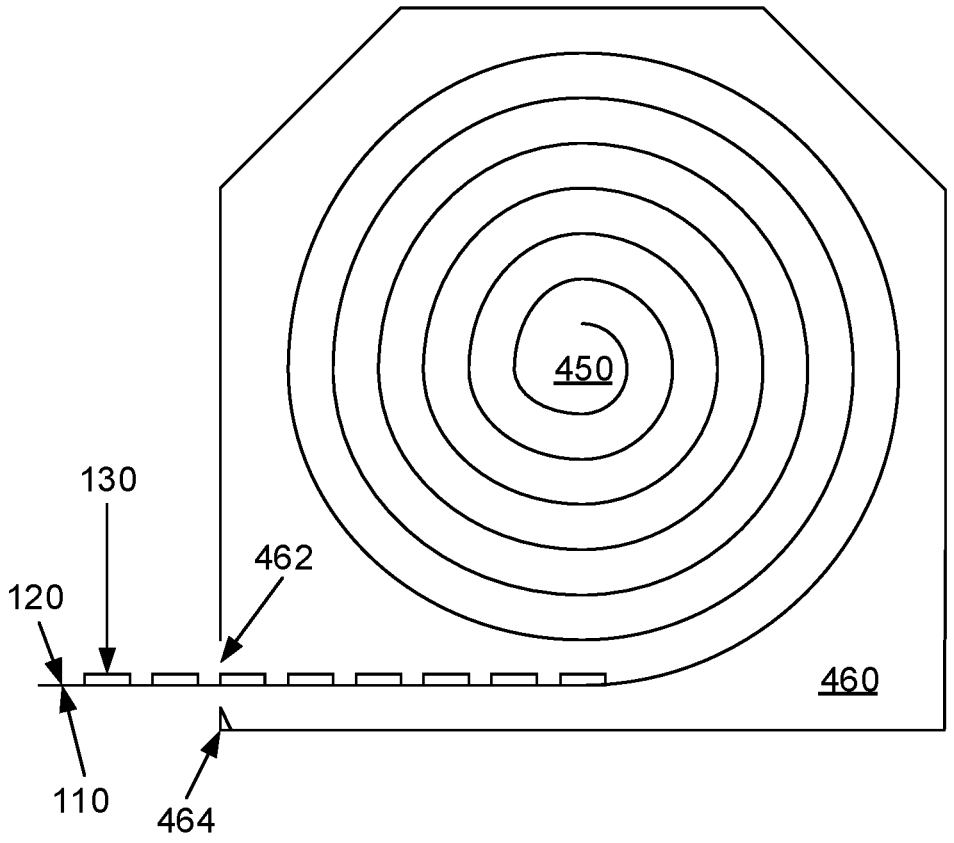
FIG. 4 shows a side view of an example of an agent dose delivery system consistent with this specification.

FIG. 4 shows a side view of an example of an agent dose delivery system (100) consistent with this specification. The system (100) includes a first strip of water-soluble film (110) and a second strip of water soluble film (120) with their compartments (130). The strips (110,120) have been rolled into a roll (450). The roll (450) fits in a dispenser (460). An end of the roll (450) may extend from the dispenser (460) through an opening (462). In an example, the opening (462) includes a cutting edge (464) to facilitate separation of the compartments (130) in the roll (450).

The system (100) is a strip formed from a first strip of water-soluble film (110) and a second strip of water-soluble film (120). The compartments (130) in the strip contain an agent composition.

The roll (450) allows for convenient, organized storage of the system (100) of FIG. 3. The roll (450) allows a single tear to provide the desired amount of agent without a remainder portion that needs to be saved for the next partial load. The roll (450) may be formed with the compartments (130) on the inside surface to protect the compartments (130) during unrolling. The roll (450) may include text and/or coloring to indicate the roll (450) is nearly consumed. This may be text, e.g., reorder now, and/or a color band, such as red or yellow.

The dispenser (460) contains the roll (450). The dispenser may be rectangular. The dispenser (460) may have the top corners removed as shown in FIG. 4. The dispenser (460) may include an axis to help the roll (450) turn. A dispenser (460) may include multiple rolls (450). In an example, the dispenser includes multiple openings (462) for the multiple rolls (450). In an example, the dispenser (450 may be tilted to the side to bring the next roll (450) into alignment with the opening (462) when a previous roll (450) is finished.

The dispenser (460) includes an opening (462). The opening may be sealed during shipment/sale. The seal may be removed by a consumer, for example, by tearing a perforation and/or removing a covering. The opening (462) allows an end of the roll (450) to extend from the dispenser (460). The opening (462) may have a same width as the roll (450). The opening (462) may be slightly narrower than the roll (450) to provide some friction to passage of the strips (110,120) forming the roll (450) through the opening (462).

The dispenser (460) may include a cutting edge (464). The cutting (464) edge may be at the opening (462). The cutting edge (464) may be on a top edge of the opening (462). The cutting edge (464) may be on a bottom (lower) edge of the opening (462). The cutting edge (464) may be on a side of the opening (462). The cutting edge (464) may be located inside the dispenser (460). The cutting edge (464) need not extend over an entire edge of the opening (462). For example, the cutting edge (464) may be located in a corner of the opening (462). The cutting edge (464) may serrated, for example, similar to the cutting edges on a package of foil. The cutting edge (464) may be a straight edge and/or curved edge.

Figure 5:
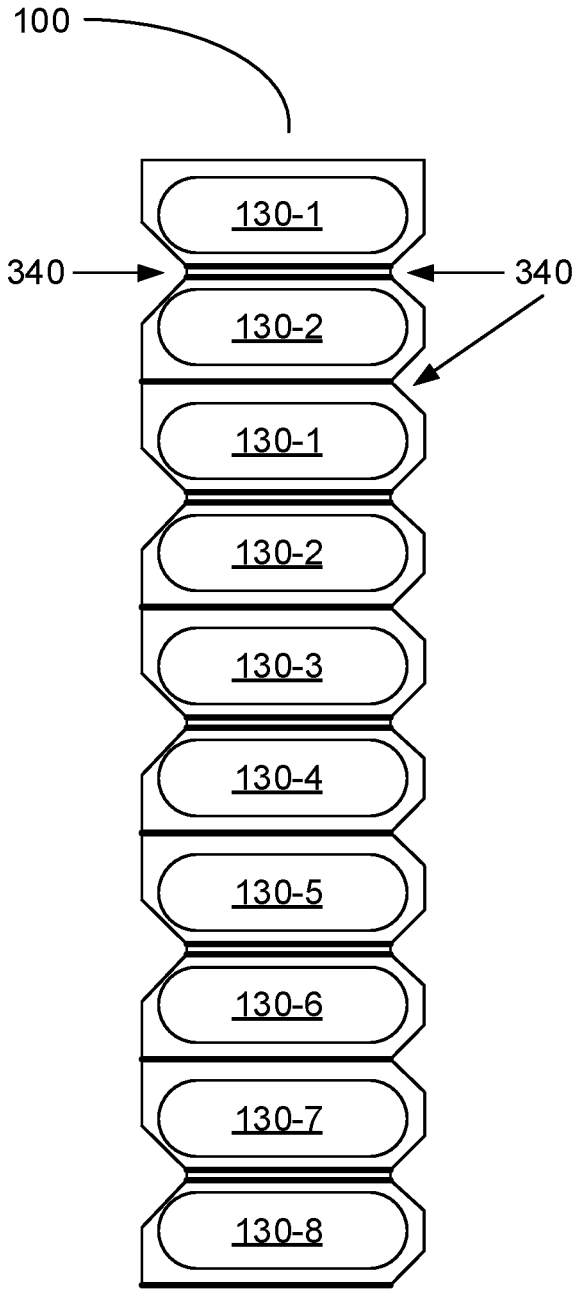
FIG. 5 shows a plan view of an example of an agent dose delivery system consistent with this specification.

FIG. 5 shows a plan view of an example of an agent dose delivery system (100) consistent with this specification. The system (100) is in strip form with a first strip of water-soluble film (110) and a second strip of water soluble film (120) used to form multiple compartments (130). Weakened areas (340) are located between adjacent compartments (130). The weakened areas may include a notch (560) on one and/or both sides of the weakened area (340).

The weakened areas (340) may be narrower width than the adjacent areas of the strip. For example, the weakened areas (340) may have a notch (560) on one and/or both sides of the strip. The weakened areas (340) may be narrowed without a notch to reduce the amount of material to tear when separating the compartments (130). In an example, one or more openings are formed in the weakened area (340) to reduce the tear force to separate the compartments (130). The one or more openings may be perforations. The one or more openings may be a slot oriented widthwise. In an example, the opening of the dispenser includes a tab that catches the slot as the strip advances. This may facilitate one-handed separation of the compartments (130). Similar engagement approaches can be imagined for other features in the weakened area (340). For example, the opening of the dispenser may have a first width near a top and/or center and a second, narrower width toward the bottom. The second width may correspond to a width of the strip in the weakened area (340) when the weakened area (340) has notches (560) on one and/or both sides. A user may lift the strip up into the wider portion of the opening and advance the strip, and then lower the strip to detach the desired portion.

The weakened area may have a thinned area, for example, formed by pressing a heating element onto the two sheets (110, 120). The weakened area (340) may have multiple parallel thinned areas as shown in FIG. 5. The use of thinned areas may guide separation and/or reduce crack propagation/tearing toward the compartments (130). In an example, there are three parallel thinned areas, with the central thinned area of the three being the thinner than the other two and preferentially tearing.

Figure 6:
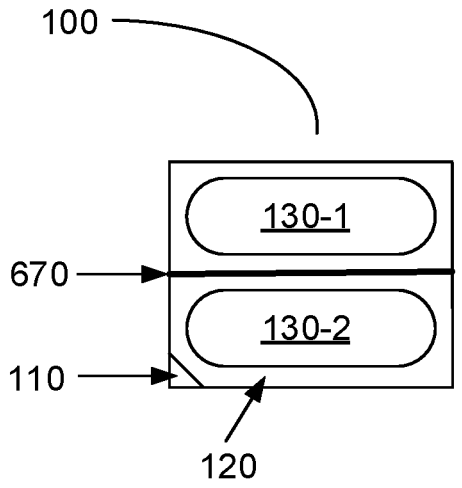
FIG. 6 shows a plan view of an example of an agent dose delivery system consistent with this specification.

FIG. 6 shows a plan view of an example of an agent dose delivery system (100) consistent with this specification. The agent dose delivery system (100) includes: a first sheet (110) and second sheet (120) of water-soluble polymer; a first compartment (130-1) and second compartment (130-2) formed between the first (110) and second sheets (120) of water soluble polymer; a first quantity of agent in the first compartment (130-1) and second quantity of agent in the second compartment (130-2), wherein the first quantity and the second quantity are equivalent volumes; and a separation zone (670) between the first compartment (130-1) and the second compartment (130-2), the separation zone (670) allowing manual separation of the first compartment (130-1) from the second compartment (130-2) without compromising an integrity of either compartment (130).

The separation zone (670) may use a notch (560) to aid separation. The separation zone (670) may be thinned compared to adjacent portions of the first sheet (110) and second sheet (120). The separation zone (670) may be perforated to facilitate separation. The separation zone (670) may include both the first sheet (110) and the second sheet (120). The separation zone (670) may contain a single sheet (110, 120) selected from the first sheet (110) and the second sheet (120). The separation zone (670) may include slots, gaps, and/or other modification to facilitate separation.

The separation zone (670) allows the first and second compartments (130) to be separated by hand without the use of a tool. The separation zone (670) may have a cut at the edge of the separation zone (670) to aid in separating the system (100). The thickness profile in the separation zone (670) may be formed, for example, under heat and/or pressure to encourage tearing along the separation zone (670) and reduce lateral tearing into the compartments (130). In an example, a thicker border of water-soluble material separates the separation zone (670) from the first and/or second compartments (130). Such a thicker border may serve to redirected lateral tearing into the desired direction by providing local stiffness which in turn concentrates stretching (and tearing) in a thinner portion of the separation zone (670).

In an example, the separation zone (670) includes a plurality of parallel impressions in the first (110) and second sheets (120) of water-soluble polymer, the parallel impressions running between (so as to separate, not to connect) the first compartment (130-1) and the second compartment (130-2) to channel tearing of the sheets (110, 120) of water-soluble polymer.

The first water-soluble sheet (110) and the water-soluble sheet (120) may be separated from each other in a portion of the separation zone (670). The first sheet of water-soluble polymer (110) and the second sheet of water soluble polymer (120) may be separated from each other over the entire separation zone (670).

The separation zone (670) may include a notch (560) in an edge of a sheet (110,120).

The width of the first water-soluble sheet (110) may be narrower in the separation zone (670) than in an adjacent portion of the first water-soluble sheet. Width may be the longest axis of the separation zone (670). Width may be the direction separation propagates in the separation zone (670).

Figure 7A:
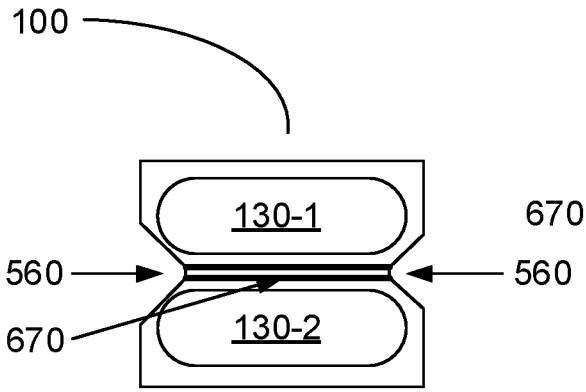
FIGS. 7A-D show plan views of examples of agent dose delivery systems consistent with this specification.

FIGS. 7A-D show plan views of examples of agent dose delivery systems (100) consistent with this specification. FIG. 7A shows a system (100) with two compartments (130) separated by a separation zone (670). The separation zone (670) includes notches on either side (560). The separation zone (670) includes a plurality of parallel impressions in the first (110) and second sheets (120) of water-soluble material, the parallel impressions running between the first compartment (130-1) and the second compartment (130-2) to channel tearing of the sheets (110, 120) of water-soluble material.

Figure 7B:
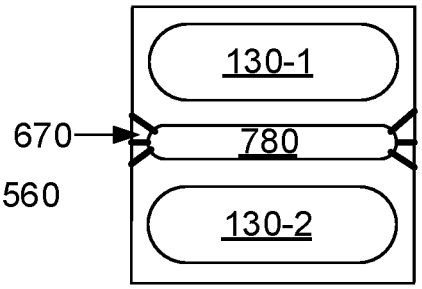

FIG. 7B shows a system (100) with two compartments (130) separated by a separation zone (670). The separation zone (670) includes an opening (780) which reduces a length of material to be torn to separate the two sides of the system (100). The opening (780) may be a slot. The opening (780) may be a plurality of openings, for example, a perforated line.

Figure 7C:
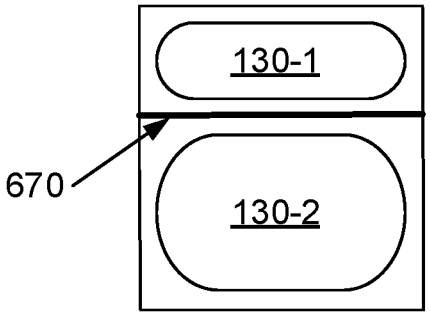

FIG. 7C shows a system (100) with two compartments (130) separated by a separation zone (670). The first compartment (130-1) has a smaller volume than the second compartment (130-2).

Figure 7D:
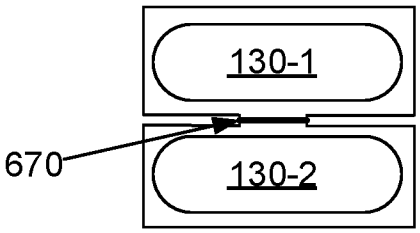

FIG. 7D shows a system (100) with two compartments (130) separated by a separation zone (670). The area between the two compartments (130) has a reduced width compared with the region near the compartments (130). Reducing the width of the separation zone (670) may reduce the force needed to separate the compartments (130).

Figure 8:
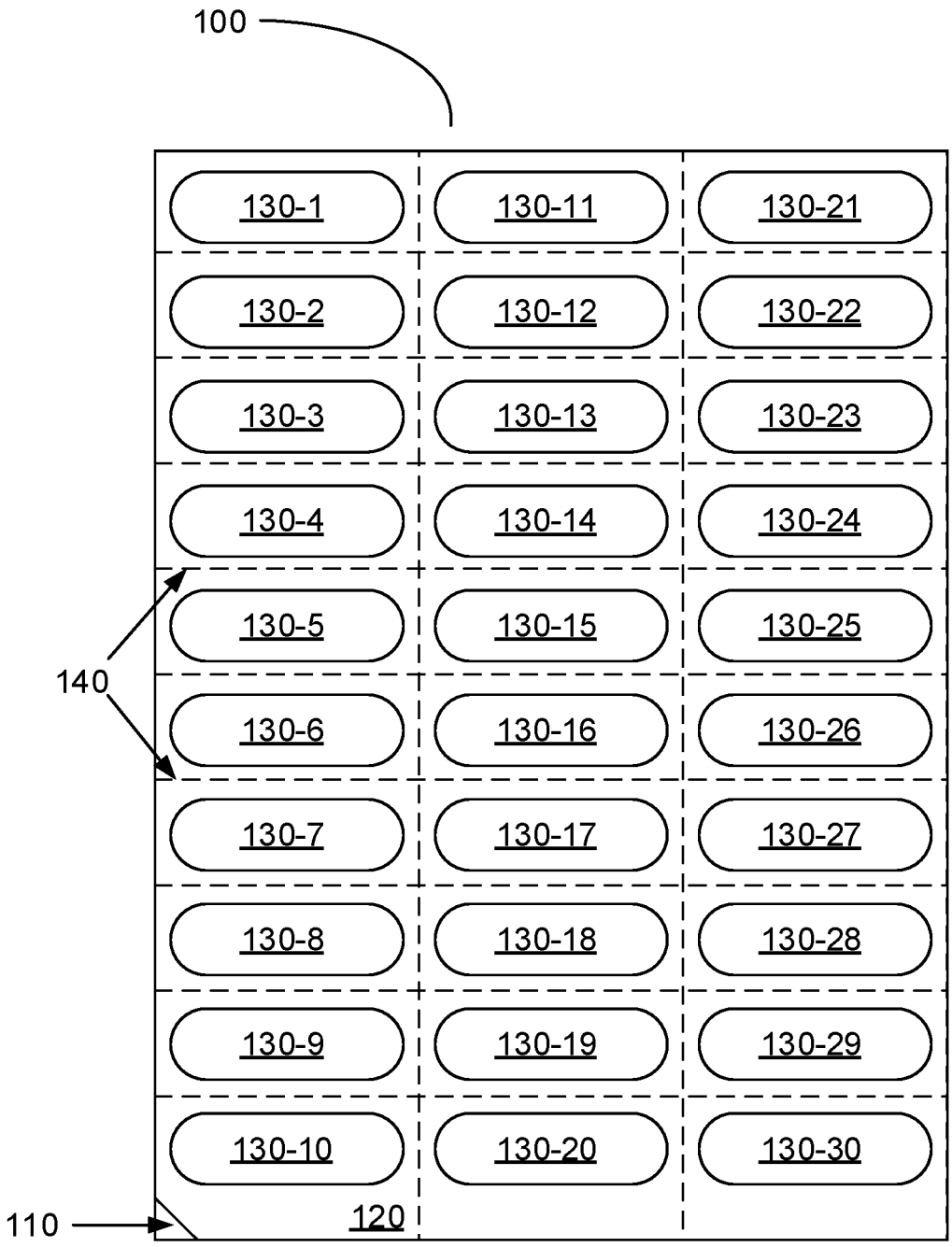
FIG. 8 shows a plan view of an example of an agent dose delivery system consistent with this specification.

FIG. 8 shows a system (100) with 30 compartments (130) separated by perforations (140). The system (100) is a sheet of doses that may be separated as desired by the user. The sheet configuration may include any of the other features described in this specification. For example, the sheet system (100) may include notches, weakened areas, tear protection, etc. While each compartment (130) is shown as individually separatable in FIG. 8, other configurations are possible. For example, the compartments may be configured in alternating groups of one compartment (130) and two compartments (130) or in groups of three compartments (130) and three compartments (130). The specific configurations of the system (100) are readily adaptable to the preferred and alternate uses of the product(s) contained in the compartments (130).

Similarly, while the compartments (130) in FIG. 8 are shown as uniformly sized, the compartment (130) size may be varied. The compartment (130) contents may be varied. The sheet system (100) includes dose units with weakened areas (340) such as perforations (140), on two adjacent sides of the dose unit. Some internal dose units may have three and/or four adjacent sides with weakened areas (340) depending on the position of the dose unit and the specific implementation of the system (100).

It will be appreciated that, within the principles described by this specification, a vast number of variations exist. It should also be appreciated that the examples described are only examples, and are not intended to limit the scope, applicability, or construction of the claims in any way.

What is claimed is:

1. An agent dose delivery system comprising:

a first strip of water-soluble film;

a second strip of water-soluble film adhered to the first strip of water-soluble film;

a plurality of compartments of a first size formed by the first and second strips of water-soluble film, the plurality of compartments containing a first agent composition; and a plurality of weakened areas located between the compartments such that the weakened areas may be used to separate adjacent compartments without rupturing either adjacent compartment;

wherein the weakened areas are crystalline and non-weakened areas of the water soluble film are amorphous.

2. The system of claim of 1, wherein the first and second strips are rolled into a roll.

3. The system of claim 2, wherein the roll is contained in a dispenser.

4. The system of claim 3, wherein the dispenser contains a plurality of rolls.

5. The system of claim 3, wherein the dispenser comprises an opening which comprises a cutting edge to facilitate separation of the compartments.

6. The system of claim 1, wherein the weakened areas comprise a notch in an edge of the first strip of water-soluble film, the notch facilitating separation of adjacent compartments.

7. The system of claim 1, wherein the weakened areas comprise two notches, one notch in either edge of the first strip of water-soluble film, the notches facilitating separation of adjacent compartments.

8. The system of claim 1, further comprising a second plurality of compartments of a second size formed by the first and second strips of water-soluble film, the plurality of compartments containing a second agent composition, wherein the first size differs from the second size and the first agent differs from the second agent.

9. The system of claim of 1, wherein perforated tear lines are provided in the plurality of weakened areas allowing separation of the compartments.

10. An agent dose delivery system comprising:

a first sheet and second water-soluble sheets;

a first compartment and second compartment formed between the first and second sheets;

a first quantity of agent in the first compartment and second quantity of agent in the second compartment, wherein the first quantity and the second quantity are equivalent; and a separation zone between the first compartment and the second compartment, the separation zone allowing manual separation of the first compartment from the second compartment without compromising an integrity of either compartment;

wherein the separation zone is crystalline and areas adjacent to the separation zone are amorphous.

11. The system of claim 10, wherein the separation zone comprises a plurality of parallel impressions in the first and second sheets, the plurality of parallel impressions running between the first compartment and the second compartment to channel tearing of the sheets of water-soluble polymer.

12. The system of claim 10, wherein the first water-soluble sheet and the second water-soluble sheet are separated from each other in a portion of the separation zone.

13. The system of claim 10, wherein the separation zone comprises a notch in an edge of a sheet selected from a group consisting of: the first water soluble sheet and the second water-soluble sheet.

14. The system of claim 10, where a width of the first water-soluble sheet is narrower in the separation zone than in an adjacent portion of the first water-soluble sheet, where width is the longest axis of the separation zone.

15. The system of claim of 10, wherein perforated tear lines are provided in the separation zone.

16. The system of claim of 10, wherein the separation zone comprises at least one notch in an edge of the first and/or second sheets, the notch facilitating separation of adjacent compartments.

* * * * *